US008513929B2

(12) United States Patent
Drebinger

(10) Patent No.: US 8,513,929 B2
(45) Date of Patent: Aug. 20, 2013

(54) METHOD FOR PROVIDING AND OPERATING AN LDO

(75) Inventor: Stephan Drebinger, Munich (DE)

(73) Assignee: Dialog Semiconductor GmbH., Kirchheim/Teck-Nabern (DE)

( * ) Notice: Subject to any disclaimer, the term of this patent is extended or adjusted under 35 U.S.C. 154(b) by 379 days.

(21) Appl. No.: 12/927,491

(22) Filed: Nov. 16, 2010

(65) Prior Publication Data

US 2011/0121800 A1 May 26, 2011

(30) Foreign Application Priority Data

Nov. 26, 2009 (EP) ..... 09177149

(51) Int. Cl.
*G05F 1/00* (2006.01)

(52) U.S. Cl.
USPC ..... 323/273; 323/311; 327/538; 327/541; 327/543

(58) Field of Classification Search
USPC ..... 323/273, 311, 312, 313, 314, 315; 327/530, 538–543, 546; 330/253, 259, 261
See application file for complete search history.

(56) References Cited

U.S. PATENT DOCUMENTS

| | | | | |
|---|---|---|---|---|
| 5,446,412 | A | 8/1995 | Kimyacioglu et al. | |
| 5,604,428 | A | 2/1997 | Koblitz et al. | |
| 6,304,131 | B1 | 10/2001 | Huggins et al. | |
| 6,340,918 | B2 | 1/2002 | Taylor | |
| 7,166,991 | B2 | 1/2007 | Eberlein | |
| 7,262,662 | B2 * | 8/2007 | Adachi | 330/259 |
| 7,405,546 | B2 | 7/2008 | Amrani et al. | |
| 7,595,627 | B1 | 9/2009 | Mahnke et al. | |
| 2003/0102851 | A1 | 6/2003 | Stanescu et al. | |
| 2005/0088153 | A1 | 4/2005 | Suzuki | |
| 2006/0017495 | A1 | 1/2006 | Lam et al. | |
| 2007/0229156 | A1 * | 10/2007 | Alenin et al. | 330/252 |
| 2009/0096433 | A1 | 4/2009 | Gerber et al. | |
| 2010/0176875 | A1 * | 7/2010 | Pulijala et al. | 327/538 |

FOREIGN PATENT DOCUMENTS

EP 1 378 808 1/2004

OTHER PUBLICATIONS

European Search Report 09177149.3-2206, Dec. 22, 2009, Dialog Semiconductor GmbH.

(Continued)

*Primary Examiner* — Nguyen Tran
(74) *Attorney, Agent, or Firm* — Saile Ackerman LLC; Stephen B. Ackerman

(57) ABSTRACT

The LDO has at least three stages supplied by a supply voltage. A first stage has a differential amplifier and a folded cascode device with a regulated current mirror. The LDO has two nodes that are configured to couple the differential amplifier and the regulated current mirror and to receive a differential signal, respectively. The regulated current mirror is configured to convert and amplify the differential signals to a single ended signal. Said LDO has a first capacitor configured for frequency compensation, said first capacitor coupled between said first stage and a second stage. The LDO has a second capacitor for balancing capacitive loading of a first cascode circuit, said second capacitor coupled between said first stage and said supply voltage. Said first cascode circuit is configured to suppress different voltages between input and output of the capacitors caused of a modulation of said supply voltage. The LDO has a second cascode circuit configured to suppress supply modulations of the differential amplifier.

28 Claims, 4 Drawing Sheets

(56) References Cited

OTHER PUBLICATIONS

"A Low-Voltage CMOS Low-Dropout Regulator With Novel Capacitor-Multiplier Frequency Compensation," by Zushu Yan et al., Circuits and Systems, 2008, ISCAS 2008, IEEE International Symposium on May 18, 2008, pp. 2685-2688.

"A Frequency Compensation Scheme for LDO Voltage Regulators," by Chaitanya K. Chava et al., IEEE Transactions on Circuits and Systems, I: Regular Papers, vol. 51, No. 6, Jun. 2004, pp. 1041-1050.

"A Transient-Enhanced Low-Quiescent Current Low-Dropout Regulator With Buffer Impedance Attenuation," by Mohammad Al-Shyoukh et al., IEEE Journal of Solid-State Circuits, vol. 42, No. 8, Aug. 2007, pp. 1732-1742.

"Single Miller Capacitor Frequency Compensation Technique for Low-Power Multistate Amplifiers," by Xiaohua Fan et al., IEEE Journal of Solid State Circuits, vol. 40, No. 3, Mar. 2005, pp. 584-592.

* cited by examiner

METHOD FOR PROVIDING AND OPERATING AN LDO

BACKGROUND

1. Field of the Invention

The disclosure relates to a low-dropout linear regulator (LDO), to a method for providing a low-dropout linear regulator (LDO) and to a method for operating a low-dropout linear regulator (LDO).

2. Background

For voltage regulators used in portable powered devices, it is desirable to provide a low output noise as well as a high Power Supply Rejection Ratio (PSRR) while powering sensitive analogue components, e.g. high-resolution analog digital converters (ADC), low-noise amplifiers, mixers, audio components or the like. For providing such low-noise supply voltages, low-dropout linear regulators (LDO) may be used.

Further, to minimize power dissipation, LDOs may be used in a post-regulation configuration cascaded with a DC/DC converter. Within such a configuration, the input of the LDO is connected to the noisy output of the DC/DC converter. Thus, the LDO may act as a post filter to supply the sensitive analogue components.

Actual demands on reducing coil size result in increasing switching frequency of the DC/DC converter. This leads to a need for the LDO to have a sufficiently high PSRR ratio also at higher frequencies of e.g. 100 kHz to 6 MHz.

Accordingly, it is an aspect of the present invention to provide a low-dropout linear regulator with an improved PSRR.

SUMMARY

According to a first aspect of the invention, a low-dropout linear regulator, LDO, is provided, said LDO having at least three stages supplied by a supply voltage, vdd. A first stage has a differential amplifier and a folded cascode device with a regulated current mirror. Further, the LDO has two nodes, a first and a second node, which are configured to couple the differential amplifier and the regulated current mirror and to receive a differential signal. The regulated current mirror is configured to convert and amplify the differential signal to a single ended signal. Furthermore, the LDO has a first capacitor configured for frequency compensation, said first capacitor coupled between said first stage and a second stage. The LDO has a second capacitor for balancing capacitive loading of a first cascode circuit, said second capacitor coupled between said first stage and said supply voltage. Said first cascode circuit is configured to suppress different voltages between an input and an output of the first and second capacitors due to modulations of said supply voltage. The LDO has a second cascode circuit configured to suppress supply modulations of the differential amplifier.

According to a second aspect of the invention, a method for providing a low-dropout linear regulator is provided, the method comprising: providing a first stage having a differential amplifier and a folded cascode device with a regulated current mirror, coupling the differential amplifier with the regulated current mirror by means of two nodes such that these two nodes are configured to receive a differential signal, the regulated current mirror configured to convert and amplify the differential signal to a single ended signal, coupling a first capacitor for frequency compensation between said first stage and a second stage, coupling a second capacitor for balancing capacitive loading of a first cascode circuit arranged between said first stage and said supply voltage, providing said first cascode circuit such that it is adapted to suppress different voltages between an input and an output of the first and second capacitors due to modulations of said supply voltage, and providing a second cascode circuit such that it is adapted to suppress supply modulations of the differential amplifier.

According to a third aspect of the invention, a method for operating a low-dropout linear regulator (LDO) is provided, said LDO having at least three stages supplied by a supply voltage, said first stage having a differential amplifier and a folded cascode device with a regulated current mirror, a first and second node coupling the differential amplifier with the regulated current mirror and receiving a differential signal, the regulated current mirror configured to convert and amplify the differential signal to a single ended signal, the method comprising: providing a frequency compensation between said first stage and a second stage by means of a first capacitor, balancing capacitive loading of a first cascode circuit arranged between said first stage and said supply voltage using a second capacitor, suppressing different voltages between an input and an output of the first and second capacitors due to modulations of said supply voltage using said first cascode circuit, and suppressing supply modulations of the differential amplifier using a second cascode circuit.

One may consider it an advantage of the proposed LDO that an improved PSRR performance may be achieved. Further, the improved PSRR performance may be achieved together with a low-output noise performance, while consuming an extreme low quiescent current.

In addition, an embodiment of a LDO of the present invention may provide a high-output current and a low-load capacitor. E.g., for a difference voltage of 1 V between an output voltage and an input voltage of the LDO and a load current of 100 mA, the LDO may achieve the following PSRR ratios for different frequencies: 80 dB at 10 kHz, 60 dB at 100 kHz, and 54 dB at 1 MHz.

Further, some embodiments of the LDO have a maximum output current of 200 mA and an output capacitance of 1.0 μF.

Further, details of the respective units of the LDO of the present invention are described. The folded cascode device of the LDO is a single-pole, high-speed operation amplifier architecture, preferably. Moreover, said folded cascode device may have differential signal paths, which may see exactly the same DC voltages. Thus, the symmetry of said folded cascode device might be excellent.

In addition, said second capacitor may be a replica compensation capacitor to said first capacitor. Said second capacitor is preferably adapted to provide an appropriate stability over all conditions of the LDO. Without said second capacitor, the replica capacitor to the first capacitor, the cascode transistors of the first cascode circuit may have a different capacitive loading which may result, in case of supply modulations, in an AC current injected by one of the PMOS transistors of the first cascode circuit into the folded cascode device. By adding said second capacitor to the LDO, the capacitive loading at the cascode transistors of the first cascode circuit is almost equal and potential AC currents caused by supply modulations may be balanced through said differential signal paths. Furthermore, said first cascode circuit may be adapted to connect the compensation capacitors, namely the first and the second capacitors. The cascode transistors of the first cascode circuit may be controlled or biased by said supply voltage in order to be in phase with the compensation capacitors in case of supply modulations. Thus, unwanted AC-currents in the second stage are prevented.

The transistors of the second cascode circuit may be controlled or biased by the output voltage of the LDO or a similar ground referenced potential to suppress supply modulations at the drains of the differential amplifier and to keep these potentials independent on the supply voltage. Such a circuitry may significantly reduce supply modulations through the transistors of the differential amplifier as well as through the regulated current mirror, even under different load conditions.

In one embodiment of the LDO, said second stage is a driver stage and said third stage is a power stage. Said driver stage is configured to drive said power stage.

The driver stage and the power stage each may have a PMOS transistor. These two PMOS transistors may be coupled to form a current mirror. The current mirror may be configured to adaptively push the non-dominant pole of the PMOS transistor of the driver stage to higher frequencies.

In a further embodiment of the LDO, said folded cascode device has a first and a second differential signal path for the differential signal received by said two nodes, said first and second nodes, coupling the differential amplifier and the regulated current mirror.

In detail, a first node receives a first part of the differential signal output from a first NMOS transistor of the differential amplifier. In an analogous way, a second node may be adapted to receive a second part of the differential signal output from a second NMOS transistor of the differential amplifier.

In a further embodiment of the LDO, said differential signal paths are arranged to see equal DC voltages.

In a further embodiment of the LDO, the respective differential signal path is connected between said voltage supply, vdd, and ground.

In a further embodiment of the LDO, said two differential signal paths have a symmetrical circuit arrangement referred to said supply voltage, vdd.

Even if the LDO is outside of its bandwidth, modulations of said supply voltage may be balanced because of the symmetry of the differential signal paths. Thus, a potential capacitive loading is balanced, also including an impedance matching.

In a further embodiment of the LDO, a third capacitor configured to provide a nested Miller compensation is coupled between an output voltage, Vout, of the LDO and a ground referenced NMOS cascode of the regulated current mirror.

Thus, said third capacitor, as a cascoded Miller compensation capacitor, may be configured to prevent capacitive coupling either between said supply voltage and said output voltage or between said supply voltage and said differential signal paths of the folded cascode device. Further, by means of said cascoded Miller compensation capacitor, an effective pole-splitting between dominant pole and load pole may be achieved.

In a further embodiment of the LDO, said second capacitor is configured to balance or compensate potential AC currents caused by supply modulations through said differential signal paths.

In a further embodiment of the LDO, said first capacitor is coupled between said second differential signal path and said second stage, and said second capacitor is coupled between said first differential signal path and said supply voltage.

Said first capacitor is an additional cascoded Miller compensation capacitor to said above-mentioned cascoded Miller compensation capacitor and adapted to push the non-dominant pole of the coupled PMOS transistor of the driver stage to higher frequencies.

In a further embodiment of the LDO, said first cascode circuit has a first and a second PMOS transistor, said two PMOS transistors being configured to be controlled by said supply voltage, in order to be in phase with said first and second capacitors. The supply voltage vdd is connected to the gates (gate terminals) of the first and second PMOS transistors.

In a further embodiment of the LDO, said differential amplifier has a first NMOS transistor controlled by a reference voltage, Vref, and a second NMOS transistor controlled by an output voltage, Vout, of the LDO.

In a further embodiment of the LDO, said second cascode circuit has a first and a second PMOS transistor. A respective PMOS transistor is arranged in each differential signal path.

In a further embodiment of the LDO, said two PMOS transistors of said second cascode circuit are controlled by a ground referenced potential to suppress supply modulations at the drains of the NMOS transistors of the differential amplifier.

In a further embodiment of the LDO, the low-dropout linear regulator has a level-shift circuit. Said level-shift circuit is configured to provide or generate said ground referenced potential by down level-shifting said output voltage such that it is ensured that the PMOS transistors of the second cascode circuit are in saturation.

In a further embodiment of the LDO, said level-shift circuit has a ground referenced p-cascode circuit coupled between said output voltage, Vout, and an output node providing said ground referenced voltage.

In a further embodiment of the LDO, said level-shift circuit has a capacitor coupled between said output node and ground.

In a further embodiment of the LDO, said first differential signal path has a third node, and said second differential signal path has a fourth node, said third and fourth nodes are configured to couple the second cascode circuit to the regulated current mirror. Said two nodes are configured to have balanced output impedances.

In a further embodiment of the LDO, said regulated current mirror has a bootstrap current mirror for balancing the output impedances of said third and fourth nodes coupling the second cascode circuit and the regulated current mirror. By balancing the output impedance of the two nodes coupling the second cascode circuit and the regulated current mirror, modulations of the supply voltage are also balanced in the two differential signal paths.

In a further embodiment of the LDO, said bootstrap current mirror has a PMOS transistor to make said first node a high-impedance node.

As a result, both, the third node coupling the second cascode circuit with the regulated current mirror in the first differential signal path and the fourth node coupling the second cascode circuit with the regulated current mirror in the second differential signal path, are high-impedance nodes.

In a further embodiment of the LDO, a serial connection of a resistor and a capacitor is coupled between said gate of said PMOS transistor and ground. Said resistor and said capacitor are configured to increase the bandwidth of a fast regulation loop of the LDO. The fast regulation loop is formed by the third capacitor 901, the regulated current mirror 130, the NMOS transistor 202, and the current mirror 902 with the PMOS transistors 201, 301, the output node for Vout and the respective connections.

Thus, the high-ohmic gate of the PMOS transistor is connected with the third node in the first differential signal connecting the second cascode circuit with the regulated current mirror. Therefore, any low-impedance node is displaced from said differential signal paths.

By means of said serial connection of the resistor and the capacitor to the gate of the PMOS transistors, an additional zero is provided and, therefore, a non-dominant pole is pushed to higher frequencies. By pushing the non-dominant pole to higher frequencies, the bandwidth of the LDO is increased. This results in a higher PSRR, even at higher frequencies.

In the present disclosure, the phrase "supply voltage" also includes supply voltage terminal. Further, the phrase "gate" also includes gate terminal.

In the following, exemplary embodiments of the present invention are described with reference to the enclosed Figures.

BRIEF DESCRIPTION OF THE FIGURES

Like or functionally-like elements in the Figures have been allotted the same reference signs if not otherwise indicated.

DETAILED DESCRIPTION OF THE INVENTION

Figure 1:
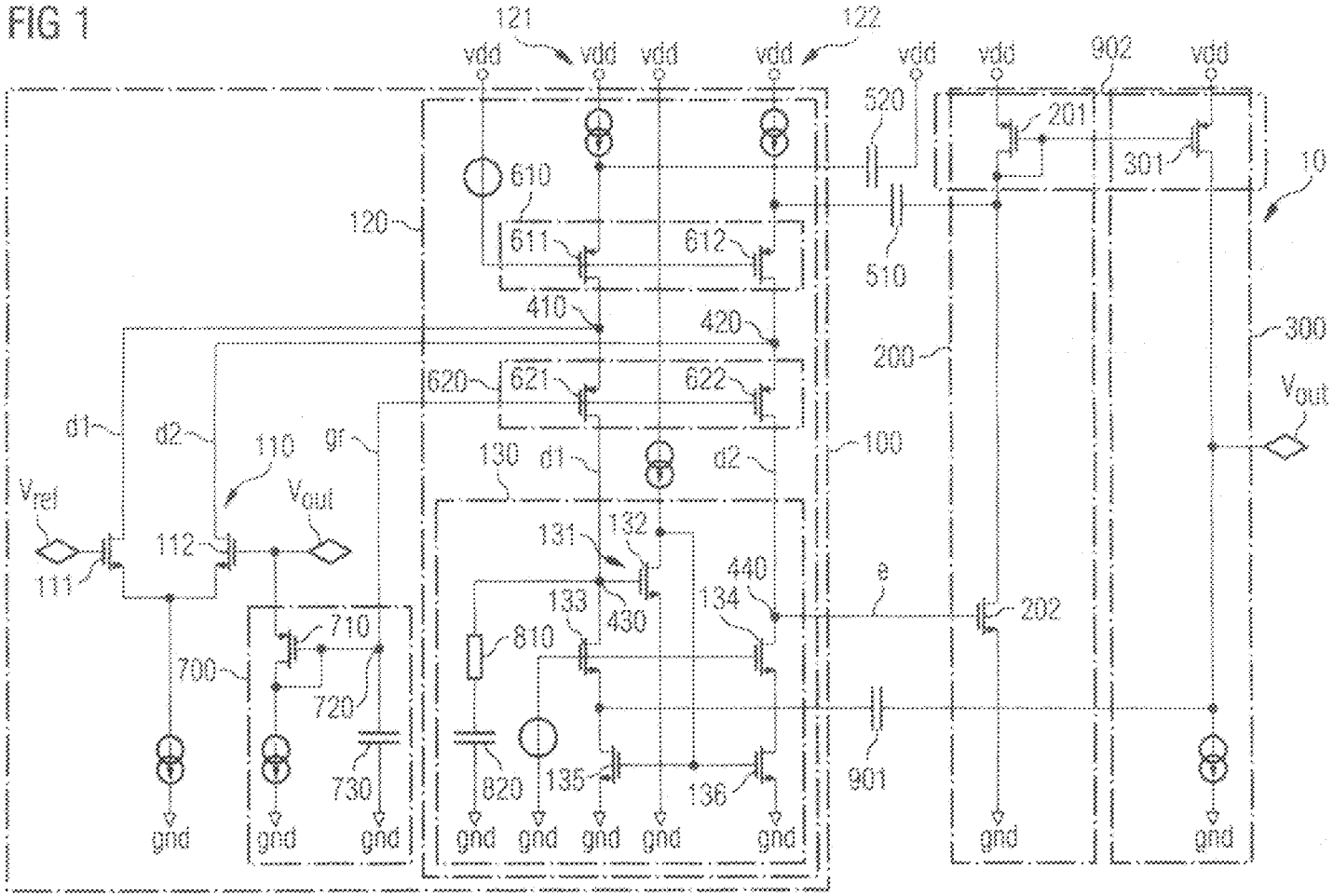
FIG. 1 shows an embodiment of an LDO.

In FIG. 1, an embodiment of the LDO 10 is illustrated.

Said LDO 10 has at least three stages 100, 200, 300, namely a first stage 100, a second stage 200 and a third stage 300. Each of said three stages 100, 200, 300 is supplied by a supply voltage vdd. The first stage 100 has a differential amplifier 110 and a folded cascode device 120 coupled with said differential amplifier 110.

Said second stage 200 is preferably a driver stage. Said third stage 300 may be a power stage, wherein the driver stage 200 is configured to drive said power stage 300.

Further, said LDO 10 has two nodes 410, 420 which are configured to couple the differential amplifier 110 to the regulated current mirror 130 of the folded cascode device 120. Said two nodes 410, 430 are configured to receive a differential signal d1, d2. Said differential signal d1, d2 is comprised of a first part d1 received by the first node 410 and second part d2 received by the second node 420. Further, said regulated current mirror 130 is configured to convert and amplify the differential signal d1, d2 to a single ended signal e. Thus, the regulated current mirror 130 receives the differential signal d1, d2 and outputs the single ended single e. To provide this function, said regulated current mirror 130 has four NMOS transistors 133-136. A first NMOS transistor 133 and a second NMOS transistor 134 of said regulated current mirror 130 form a ground referenced NMOS cascode.

Moreover, said folded cascode device 120 may have a first and a second differential signal path 121, 122 for the differential signal d1, d2 received by said two nodes 410 and 420. Said differential paths 121, 122 may be arranged to see equal DC voltages. Thus, the respective differential path 121, 122 is connected between said supply voltage vdd and ground gnd. For balancing modulations of said supply voltage vdd, said two differential signal paths 121, 122 have a symmetrical circuit arrangement referred to said supply voltage vdd.

Further, LDO 10 has a first capacitor 510 for frequency compensation. Said first capacitor 510 is coupled between said first stage 100 and said second stage 200. Furthermore, said LDO 10 has a second capacitor 520 for balancing capacitive loading of a first cascode circuit 610. Said second capacitor 520 is coupled between said first stage 100 and said supply voltage vdd. In addition, said second capacitor 520 may be configured to balance potential AC currents caused by supply modulations of said supply voltage vdd through said differential signal paths 121, 122.

Said first capacitor 510 is coupled between said second differential signal path 122 and the second stage 200. Said second capacitor 520 is coupled between said first differential signal path 121 and said supply voltage vdd.

Further, said LDO 110 has said first cascode circuit 610 and a second cascode circuit 620. Said first cascode circuit 610 is configured to suppress different voltages between input and output of the capacitors 510, 520 caused by modulations of said supply voltage vdd.

In detail, said first cascode circuit 610 has two PMOS transistors 611, 612. Said two PMOS transistors 611, 612 are adapted to be controlled or biased by said supply voltage vdd in order to be in phase with said first and second capacitors 510, 520. Hence, the central terminals (gate) of the two transistors 611, 612 are coupled to the supply voltage vdd.

Furthermore, said second cascode circuit 620 is adapted to suppress supply modulations of the differential amplifier 110. Also, said second cascode circuit 620 has two PMOS transistors 621, 622, one PMOS transistor 621, 622 in each differential signal path 121, 122.

Moreover, said two PMOS transistors 621, 622 of the second cascode circuit 620 are controlled or biased by a ground referenced potential gr to suppress supply modulations at the drains of the NMOS transistors 111, 112 of the differential amplifier 110. In this regard, said differential amplifier 110 has a first NMOS transistor 111 controlled by reference voltage Vref and a second NMOS transistor 112 controlled by the output voltage Vout of the LDO 10. Both cascode circuits 610, 620 have one PMOS transistor 611, 621, 612, 622 in the first differential signal path 121 and in the second differential signal path 122, respectively.

Moreover, said first differential signal path 121 has a third node 430. In an analogous way, said second differential path 122 has a fourth node 440. Said third and fourth nodes 430, 440 are configured to couple said second cascode circuit 620 to the regulated current mirror 130. Said two nodes 430, 440 are configured to have balanced output impedances.

As indicated above, said regulated current mirror 130 has four NMOS transistors 133-136. Further, said regulated current mirror 130 has a bootstrap current mirror 131 for balancing the impedances of said two nodes 430, 440. By balancing the impedances of these two nodes 430, 440, also modulations of the supply voltage vdd are balanced in the two differential signal paths 121, 122. In detail, said bootstrap current mirror 130 comprises a PMOS transistor 132 to make said first node 430 a high-impedance node.

Moreover, a serial connection of a resistor 810 and a capacitor 820 is coupled between a gate (gate terminal) of said PMOS transistor 132 and ground. Said resistor 810 and said capacitor 820 may be configured to increase the bandwidth of a fast regulation loop of the LDO 10.

Furthermore, said LDO 10 has a capacitor 901 coupled between the output voltage Vout of the LDO 10 and the ground referenced NMOS cascode of the regulated current mirror 130.

In addition, the LDO 10 has a level-shift circuit 700. Said level-shift circuit 700 is configured to provide said ground referenced potential gr by down-level shifting said output voltage Vout such that it is ensured that the PMOS transistors 611, 612, 621, and 622 of the cascode circuits 610, 620 are in saturation.

In detail, said level-shift circuit 700 may have a ground referenced p-cascode circuit 710. Said ground referenced p-cascode circuit 710 may be coupled between said output voltage Vout and an output node 720 outputting said ground referenced voltage gr. Further, said level-shift circuit 700 may have a capacitor 730 coupled between said output node 720 and ground.

Said fourth node 440 of the folded cascode device 120 is connected to a gate of a NMOS transistor 202 of the driver stage 200. The single-ended signal e provided by said fourth node 440 is coupled to the gate of said NMOS transistor 202 of the driver stage 200.

The driver stage 200 and the power stage 300 may have a respective PMOS transistor 201, 301. These two PMOS transistors 201 and 301 are coupled to form a current mirror 902. The current mirror 902 is configured to adaptively push the non-dominant pole of the PMOS transistor 201 to higher frequencies.

Figure 2:
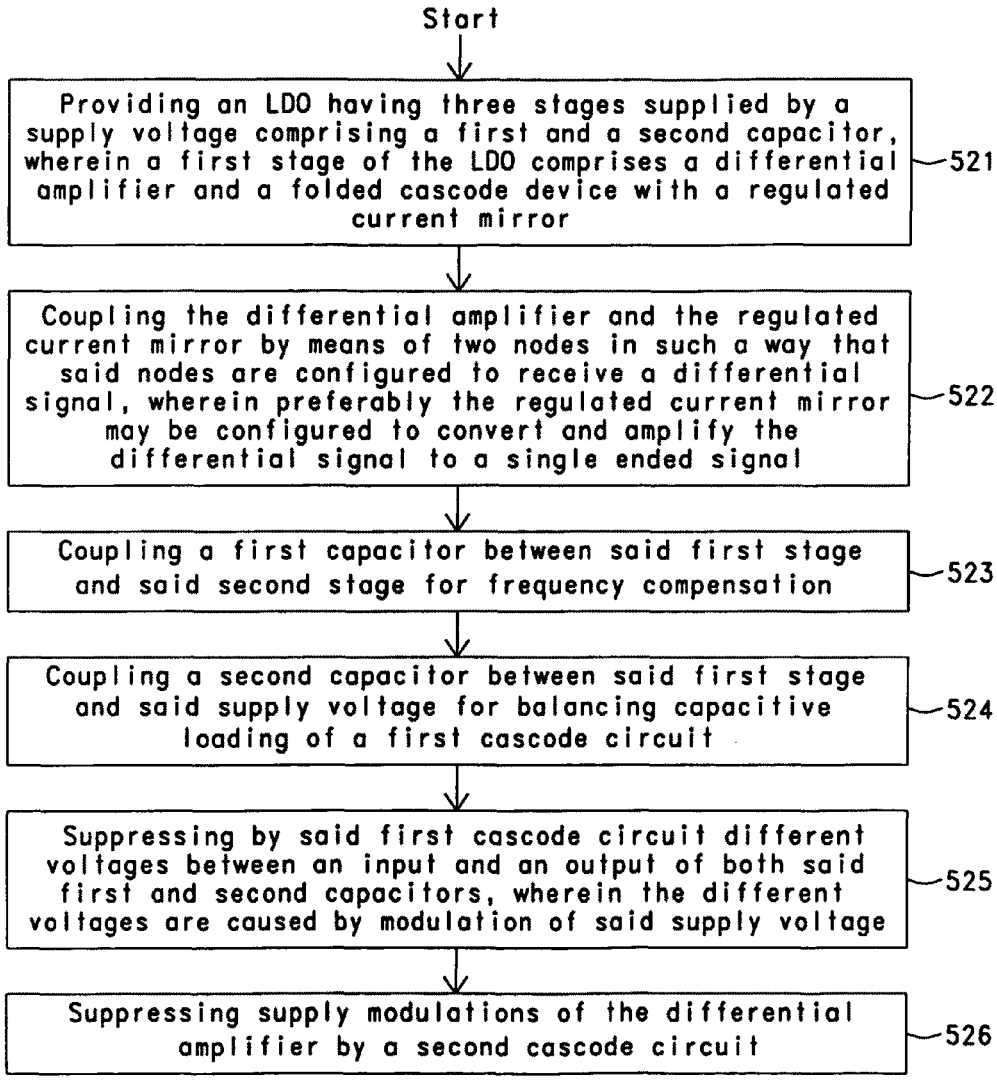
FIG. 2 shows an embodiment of a method for producing an LDO.

FIG. 2 is an embodiment of the method for providing an LDO 10 having at least three stages 100, 200, 300 supplied by supply voltage vdd. The embodiment of the method of FIG. 2 has the following method steps S21 to S26 and is described with reference to FIG. 1:

Method Step S21:

A first stage 100 is provided, said first stage 100 having a differential amplifier 110 and a folded cascode device 120 with a regulated current mirror 130.

Method Step S22:

The differential amplifier 110 and the regular current mirror 130 are coupled by means of two nodes 410, 420 in such a way that the nodes 410, 420 are configured to receive a differential signal d1, d2. Preferably, the regulated current mirror 130 may be configured to convert and amplify the differential signal d1, d2 to a single-ended signal e.

Method Step S23:

A first capacitor 510 for frequency compensation is coupled between said first stage 100 and said second stage 200.

Method Step S24:

A second capacitor 520 for balancing capacitive loading of a first cascode circuit 610 is coupled between said first stage 100 and said supply voltage vdd.

Method Step S25:

Said first cascode circuit 610 is arranged in such a way that it is adapted to suppress different voltages between an input and an output of the capacitors 510, 520 caused by a modulation of said supply voltage vdd.

Method Step S26:

A second cascode circuit 620 is provided such that it is configured to suppress supply modulations of the differential amplifier 110.

Figure 3:
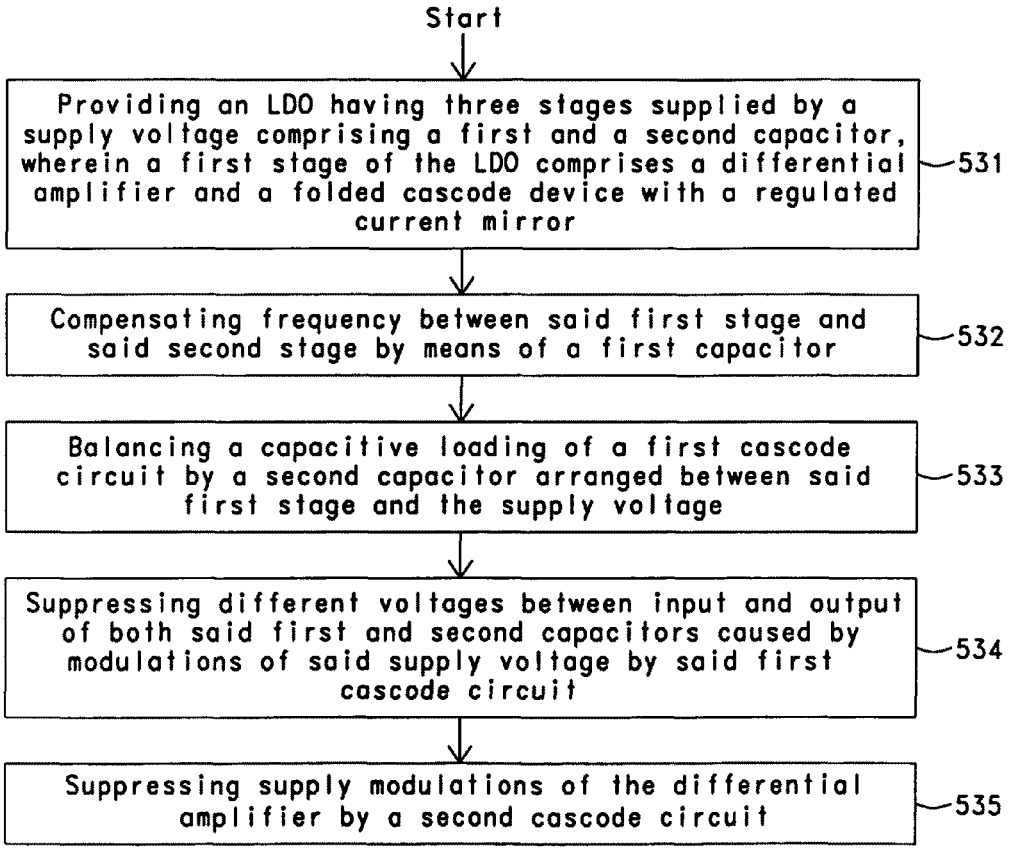
FIG. 3 shows an embodiment of the method for operating an LDO.

Further, FIG. 3 shows an embodiment of the method for operating an LDO 10 having at least three stages 100, 200, 300 supplied by a supply voltage vdd. Said LDO 10 comprises a first stage 100, said first stage 100 having a differential amplifier 110, and a folded cascode device 120 with a regulated current mirror 130. Two nodes 410, 420 couple the differential amplifier 110 to the regulated current mirror 130 and receive a differential signal d1, d2. The regulated current mirror 130 is configured to convert and amplify the differential signal d1, d2 to a single-ended signal e.

The embodiment of the method of FIG. 3 has the following method steps S31 to S34 and is described with reference to FIG. 1.

Method Step S31:

A frequency compensation is provided between said first stage 100 and said second stage 200 by means of a first capacitor 510.

Method Step S32:

A capacitive loading of a first cascode circuit 610 is balanced by means of a second capacitor 520 arranged between said first stage 100 and the supply voltage vdd.

Method Step S33:

Different voltages between input and output of the capacitors 510, 520 caused by modulations of said supply voltage vdd are suppressed by means of said first cascode circuit 610.

Method Step S34:

Supply modulations of the differential amplifier 110 are suppressed by means of a second cascode circuit 620.

Figure 4:
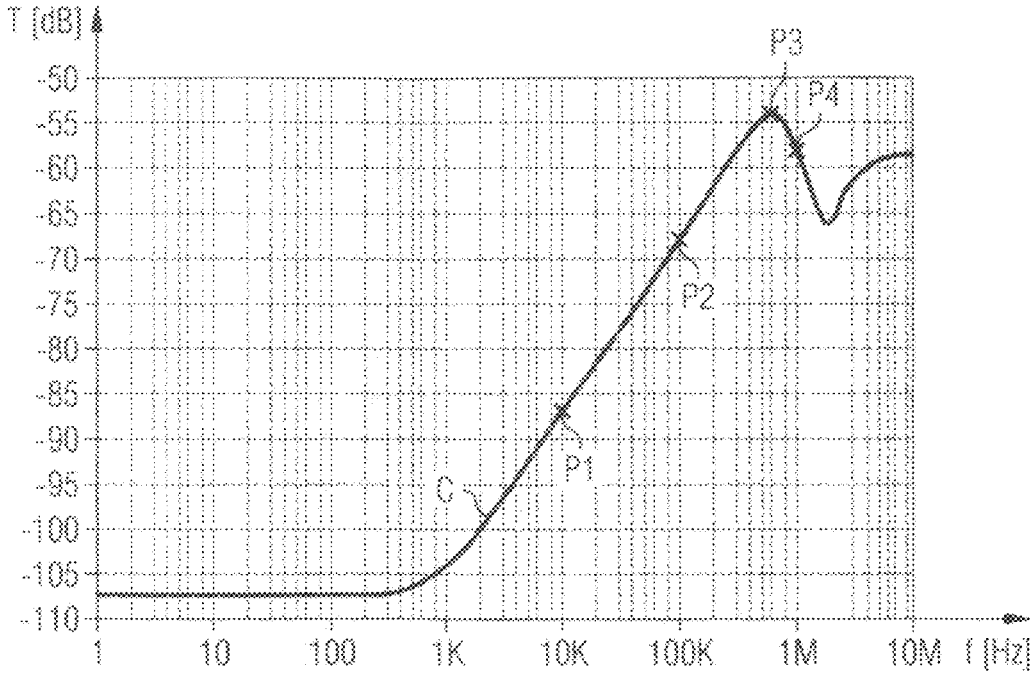
FIG. 4 shows a diagram illustrating simulation results according to the present invention.

FIG. 4 shows a diagram illustrating simulation results according to the present invention.

The x-axis represents the transfer function T in dB between Vout and Vin, wherein the PSRR may be derived from the transfer function T. The y-axis represents the frequency f in Hz.

The parameters for the simulation as shown in FIG. 4 are as follows: Vout=2.5V, Vin=3V, Iload=100 mA, and Cload=1 μF.

In FIG. 4, the curve C shows the dependence of the transfer function T on the frequency f. The four points P1-P4 may be of interest: In P1, the transfer function T is −87 dB for f=10 kHz.

With increasing the frequency f from P1 to P2 and P3, also the transfer function T increases: In P2, the transfer function T is −67.5 dB at 100 kHz, and in P3 the transfer function T is −54 dB at 800 kHz.

With increasing the frequency f from P3 to P4, the transfer function T decreases: In P4, the transfer function T is −58 dB at 1 MHz.

What has been described herein is merely illustrative of the application of the principles of the present invention. Other arrangements and systems may be implemented by those skilled in the art without departing from the scope of this invention.

What is claimed is:

1. A Low-dropout linear regulator having at least three stages supplied by a supply voltage, comprising:

a first stage having a differential amplifier and a folded cascode device with a regulated current mirror;

a first and a second node coupling the differential amplifier and the regulated current mirror and receiving a differential signal, the regulated current mirror configured to convert and amplify the differential signal to a single ended signal, a first capacitor for frequency compensation, said first capacitor coupled between said first stage and a second stage;

a second capacitor for balancing capacitive loading of a first cascode circuit, said second capacitor coupled between said first stage and said supply voltage, wherein said first cascode circuit is configured to suppress different voltages between an input and an output of the first and second capacitors due to modulations of said supply voltage; and a second cascode circuit configured to suppress supply modulations of the differential amplifier.

2. The Low-dropout linear regulator of claim 1, wherein said folded cascode device has a first and a second differential signal path for the differential signal received by said first and second node.

3. The Low-dropout linear regulator of claim 2, wherein said two differential signal paths are configured to receive equal DC voltages, wherein the respective differential signal path is connected between said voltage supply and ground.

4. The Low-dropout linear regulator of claim 2, wherein said two differential signal paths are symmetrically arranged with respect to said supply voltage.

5. The Low-dropout linear regulator of claim 1, further comprising a third capacitor configured to provide a nested Miller compensation, the third capacitor being coupled between an output voltage of the LDO and a ground referenced NMOS cascode of the regulated current mirror.

6. The Low-dropout linear regulator of claim 2, wherein said second capacitor is configured to balance AC currents caused by supply modulations through said differential signal paths.

7. The Low-dropout linear regulator of claim 2, wherein said first capacitor is coupled between said second differential signal path and said second stage and said second capacitor is coupled between said first differential signal path and said supply voltage.

8. The Low-dropout linear regulator of claim 1, wherein said first cascode circuit has a first and a second PMOS transistor, said two PMOS transistors configured to be controlled by said supply voltage in order to be in phase with said first and second capacitors.

9. The Low-dropout linear regulator of claim 1, wherein said second cascode circuit has a first and a second PMOS transistor, one PMOS transistor is arranged in each differential signal path, wherein said two PMOS transistors of said second cascode circuit are controlled by a ground referenced potential to suppress supply modulations at the drains of the NMOS transistors of the differential amplifier.

10. The Low-dropout linear regulator of claim 9, further comprising a level-shift circuit, said level-shift circuit configured to provide said ground referenced potential, wherein said level-shift circuit shifts said output voltage down such that the first and second PMOS transistors of the second cascode circuit are in saturation, wherein said level-shift circuit has a ground referenced p-cascode circuit coupled between said output voltage and an output node providing said ground referenced voltage.

11. The Low-dropout linear regulator of claim 2, wherein said first differential signal path has a third node and said second differential signal path has a fourth node, said third and fourth nodes are configured to couple the second cascode circuit with the regulated current mirror, wherein said third and fourth nodes are configured to have balanced output impedances.

12. The Low-dropout linear regulator of claim 11, wherein said regulated current mirror has a bootstrap current mirror for balancing output impedances of said third and fourth nodes.

13. The Low-dropout linear regulator of claim 12, wherein said bootstrap current mirror has a PMOS transistor to make said first node a high-impedance node.

14. The Low-dropout linear regulator of claim 13, wherein a resistor and a capacitor are coupled in series between a gate of said PMOS transistor and ground, said resistor and said capacitor configured to increase the bandwidth of a fast regulation loop of the LDO.

15. A method for operating a low-dropout linear regulator, LDO, the LDO comprising at least three stages supplied by a supply voltage, the first stage having a differential amplifier and a folded cascode device with a regulated current mirror, a first and second node coupling the differential amplifier with the regulated current mirror and receiving a differential signal, the regulated current mirror configured to convert and amplify the differential signal to a single ended signal, the method comprising:

providing a frequency compensation between said first stage and a second stage by means of a first capacitor;

balancing capacitive loading of a first cascode circuit using a second capacitor arranged between said first stage and said supply voltage;

suppressing different voltages between an input and an output of the first and second capacitors due to modulations of said supply voltage by means of said first cascode circuit; and suppressing supply modulations of the differential amplifier using a second cascode circuit.

16. The method for operating an LDO of claim 15 wherein the LDO comprises a first and a second node, which are configured to couple the differential amplifier and the regulated current mirror, and to receive a differential signal.

17. The method for operating an LDO of claim 16 wherein the regulated current mirror is configured to convert and amplify the differential signal to a single ended signal.

18. The method for operating an LDO of claim 16 wherein said folded cascode has a first and second differential signal path for the differential signal.

19. The method for operating an LDO of claim 18 wherein said two differential signal paths have a symmetrical circuit arrangement referred to said supply voltage.

20. The method for operating an LDO of claim 15 wherein said second capacitor is a replica compensation capacitor to said first capacitor.

21. The method for operating an LDO of claim 15 wherein said first cascode circuit is adapted to connect said first and second capacitors.

22. The method for operating an LDO of claim 15 wherein said second stage is a driver stage and said third stage is a power stage, which is driven by said driver stage.

23. The method for operating an LDO of claim 15 wherein said second stage is a driver stage and said third stage is a power stage, which is driven by said driver stage.

24. A method for providing a low-dropout linear regulator (LDO) with an improved PSSR, the method comprising:

providing an LDO having at least three stages a first stage supplied by a supply voltage, comprising a differential amplifier and a folded cascode device with a regulated current mirror;

coupling the differential amplifier with the regulated current mirror by means of two nodes such that these two nodes are configured to receive a differential signal; and providing frequency compensation by a first capacitor coupled between the first stage and a second stage;

balancing capacitive loading of a first cascade circuit by a second capacitor coupled between the first stage and said supply voltage; and suppressing voltage difference between an input and an output of both of said first and second capacitors.

25. The method for providing a low-dropout linear regulator of claim 24 wherein the regulated current mirror is configured to convert and amplify the differential signal to a single-ended signal.

26. The method for providing a low-dropout linear regulator of claim 24 wherein the LDO has three stages.

27. The method for providing a low-dropout linear regulator of claim 24 wherein said voltages are caused by modulation of said supply voltage.

28. The method for providing a low-dropout linear regulator of claim 24 wherein supply modulation of the differential amplifier is suppressed by a second cascode circuit.

* * * * *